US010428498B1

(12) United States Patent
Montague

(10) Patent No.: US 10,428,498 B1
(45) Date of Patent: Oct. 1, 2019

(54) TOUCHLESS WATER AND LIQUID SOAP DISPENSING FAUCET

(71) Applicant: Sarah Montague, San Francisco, CA (US)

(72) Inventor: Sarah Montague, San Francisco, CA (US)

( * ) Notice: Subject to any disclaimer, the term of this patent is extended or adjusted under 35 U.S.C. 154(b) by 35 days.

(21) Appl. No.: 15/840,801

(22) Filed: Dec. 13, 2017

Related U.S. Application Data

(60) Provisional application No. 62/519,259, filed on Jun. 14, 2017.

(51) Int. Cl.

| | |
|---|---|
| ***E03C 1/05*** | (2006.01) |
| ***A47K 5/12*** | (2006.01) |
| ***E03C 1/046*** | (2006.01) |
| ***E03C 1/04*** | (2006.01) |

(52) U.S. Cl.
CPC ..... *E03C 1/057* (2013.01); *A47K 5/1217* (2013.01); *E03C 1/04* (2013.01); *E03C 1/0465* (2013.01); *A47K 2005/1218* (2013.01)

(58) Field of Classification Search
CPC ..... E03C 1/046; A47K 5/1217; A47K 2005/1218
See application file for complete search history.

(56) References Cited

U.S. PATENT DOCUMENTS 4,398,310 A 8/1983 Lienhard
4,802,630 A 2/1989 Kromrey et al.
4,839,039 A * 6/1989 Parsons ..... A47K 5/1217 137/551
5,031,258 A * 7/1991 Shaw ..... E03C 1/057 242/563
5,425,396 A * 6/1995 Wodeslaysky ..... E03B 7/071 137/488
5,540,362 A 7/1996 Azuma et al.
5,857,594 A 1/1999 Ozturk
5,868,311 A 2/1999 Cretu-Petra
RE37,888 E 10/2002 Cretu-Petra
6,929,150 B2 8/2005 Muderlak et al.
7,228,874 B2 * 6/2007 Bolderheij ..... E03C 1/04 137/801
7,406,722 B2 8/2008 Fukuizumi et al.
7,458,523 B2 12/2008 Hyslop
7,537,023 B2 5/2009 Marty et al.
(Continued)

*Primary Examiner* — Erin Deery
(74) *Attorney, Agent, or Firm* — Cramer Patent & Design, PLLC; Aaron R. Cramer

(57) ABSTRACT

A faucet assembly having an inlet port connected to a water passageway for receiving water from a water supply line, and a soap passageway for receiving liquid soap. An upwardly extending stalk having both a water discharge port connected to the water passageway and a soap discharge port connected to the soap passageway. A soap cartridge provides liquid soap to the soap passageway. A water activation sensor on the stalk is in electrical communication with a water valve in the water passageway. A soap activation sensor on the stalk is in electrical communication with a soap pump in the soap passageway. The soap discharge port is below the water discharge port. The water activation sensor selectively causes water to flow from the water discharge port while the soap activation sensor selectively causes liquid soap to flow from the soap discharge port.

15 Claims, 4 Drawing Sheets

(56) References Cited

U.S. PATENT DOCUMENTS

| | | | | |
|---|---|---|---|---|
| 8,087,543 | B2 * | 1/2012 | Yang | A47K 5/1217 222/333 |
| 8,371,474 | B2 | 2/2013 | Tramontina et al. | |
| 9,945,104 | B2 * | 4/2018 | Wang | A47K 5/14 |
| 9,995,025 | B2 * | 6/2018 | Wang | E03C 1/057 |
| 10,010,223 | B2 * | 7/2018 | Burgo, Sr. | E03C 1/046 |
| 10,041,236 | B2 * | 8/2018 | Loberger | E03C 1/057 |
| 10,087,608 | B2 * | 10/2018 | Dobizl | E03C 1/046 |
| 2009/0100593 | A1 | 4/2009 | Lincoln et al. | |
| 2012/0260729 | A1 | 10/2012 | Bayley et al. | |
| 2015/0083748 | A1 | 3/2015 | McHale et al. | |
| 2016/0069052 | A1 | 3/2016 | Burgo, Sr. et al. | |

* cited by examiner

TOUCHLESS WATER AND LIQUID SOAP DISPENSING FAUCET

RELATED APPLICATIONS

The present invention is a continuation-in-part of and claims the benefit of U.S. Provisional Patent Application No. 62/519,259 filed on Jun. 14, 2017, the entire disclosures of which are incorporated herein by reference.

FIELD OF THE INVENTION

The presently disclosed subject matter is directed to liquid-dispensing faucets. More particularly, the present invention relates to touch-less water and liquid soap dispensing faucets.

BACKGROUND OF THE INVENTION

The health benefits of washing one's hands in a medical center, in the food industry or after a visit to the bathroom are widely known. Those benefits include reducing the spread of bacteria and the germs which can lead to disease and illness, not to mention general cleanliness. To further bathroom cleanliness and hand hygiene manufacturers have developed hands-free faucets which automatically turn on water flow after sensing the presence of a user's hands under the faucet.

Following the wide acceptance of hands-free faucets manufacturers have also developed hands-free liquid soap dispensers. These have also proven useful and have been widely accepted. In the prior art hands-free liquid soap dispensers and hands-free water faucets were available as discrete units, each requiring its own battery power source as well as its own sink or counter space (which may not be available). Therefore, prior art hands-free liquid soap dispensers were typically placed on a nearby wall, counter, or sink. While functionally successful, such hands-free liquid soap dispensers each require their own power source and tend to be unsightly which can lead to a cluttered look. More importantly, wall-mounted hands-free liquid soap dispensers can lead to soap spills on the floor which can result in slips and falls.

Accordingly, there exists a need for a combination hands-free faucet that enables a user to use both soap and water to wash their hands. Preferably, such a faucet would not be separately mounted, would not present a cluttered look, would not require counter or sink space, and would not readily lead to slips and falls. Ideally such a combination faucet would be easy to use, readily installed, could be made at relatively low cost, and would assist maintaining cleanliness.

SUMMARY OF THE INVENTION

The principles of the present invention provide for an integrated, hands-free soap and water dispensing faucet that does not increase clutter, is sink-mounted, is easy to use, can be readily installed, and can be made at relatively low cost and without requiring an additional battery. In addition, such an integrated, hands-free soap and water dispensing faucet assists cleanliness, conserves energy and resources while reducing transmission of diseases.

A faucet assembly in accord with the present invention includes an inlet port connected to a water passageway for receiving water from a water supply line, and a soap passageway for receiving liquid soap. The faucet assembly further includes an upwardly extending stalk having a water discharge port that is connected to the water passageway and a soap discharge port that is connected to the soap passageway. Also included is a soap cartridge for providing liquid soap to the soap passageway. A water activation sensor is attached to the stalk. That water activation sensor is in electrical communication with a water valve in the water passageway. A soap activation sensor is also attached to the stalk. That soap activation sensor is in electrical communication with a soap pump that is located in the soap passageway between the soap cartridge and the soap discharge port. The soap discharge port is below the water discharge port, the water activation sensor selectively causes water to flow from the water discharge port, and the soap activation sensor selectively causes liquid soap to flow from the soap discharge port.

In the practice the water activation sensor initiates automatic water discharge from the water discharge port. The water activation sensor can be an electronic sensor or an acoustic sensor. Beneficially the soap activation sensor automatically initiates soap discharge from the soap discharge port. In addition, the faucet assembly may include a manually-operated soap activation switch which also initiates soap discharge from the soap discharge port. The water activation sensor may be above the soap discharge port and the soap activation sensor can be below the soap discharge port. Preferably the soap discharge port extends away from the remainder of the stalk so as to block the water activation sensor from sensing a user's hands when those hands are below the soap discharge port.

Some faucet assemblies only discharge cold water. There may be a hydro generator in the water passageway which is capable of generating electrical power for the water activation sensor, the soap pump, and the soap activation sensor. There may also be a pressure control valve that is located in the water passage. Preferably the soap cartridge is sealed.

Another faucet assembly that is in accord with president invention includes a base plate, a sink; and a faucet assembly that is connected to the base plate and above the sink. The faucet assembly includes an inlet port connected to a water passageway for receiving water from a water supply line and a soap passageway for receiving liquid soap. The faucet assembly further includes an upwardly extending stalk having a water discharge port that is connected to the water passageway and a soap discharge port that is connected to the soap passageway. Also included is a soap cartridge for providing liquid soap to the soap passageway. The faucet assembly further includes an automatic water dispensing system having a water activation sensor that is attached to the stalk, an automatic soap dispensing system having an automatic soap activation sensor that is attached to the stalk, and a manually operated soap activation switch that is attached to the stalk and which is in electrical communication with the automatic soap dispensing system. The automatic water dispensing system is for automatically discharging water from the water discharge port when a user's hands are sensed by the water activation sensor. The automatic soap dispensing system is for automatically discharging soap from the soap discharge port when a user's hands are sensed by the automatic soap activation sensor. The water activation sensor is above the soap discharge port while the automatic soap activation sensor is below the soap discharge port.

In practice, the soap discharge port extends away from the stalk sufficiently to block the water activation sensor from sensing a user's hands when those hands are below the soap discharge port. In addition, the automatic water dispensing system automatically discharges water for no more than a preset period of time and also stops discharging water when a user moves his hands away from the water activation sensor. The automatic soap dispensing system automatically discharges a predetermined volume of soap when the automatic soap activation sensor senses a user's hand. Furthermore, the automatic soap dispensing system automatically discharges a predetermined volume of soap when the manually operated soap activation switch is pressed. The automatic water dispensing system includes a first timing circuit triggered by the water activation sensor. Preferably the soap reservoir cartridge is sealed.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
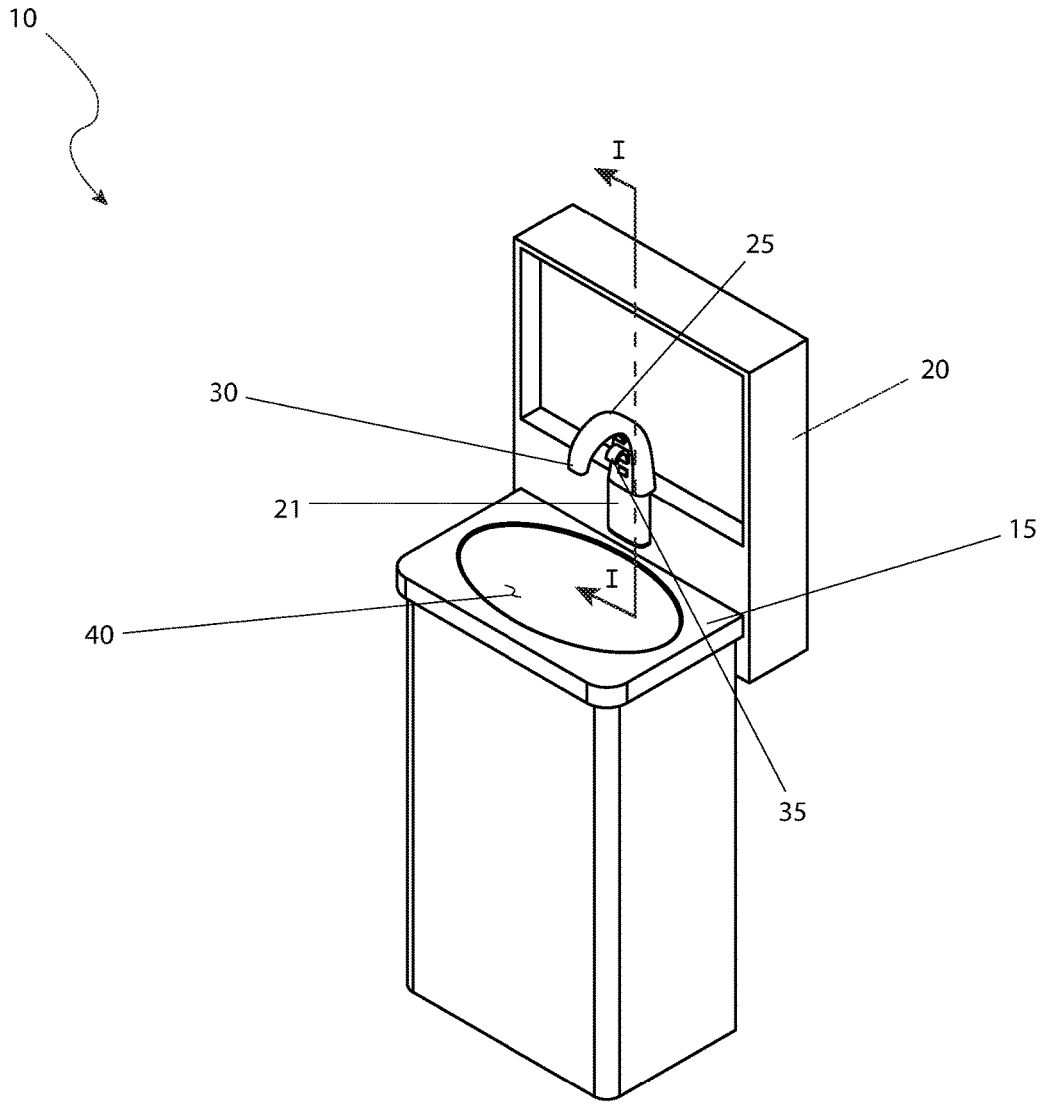
FIG. 1 is an overall perspective view of an installed integrated soap and water dispensing faucet assembly 10 (hereinafter the "faucet assembly 10") that is in accord with the principles of the present invention and which is shown mounted on a typical sink 15.

10 faucet assembly
15 sink
20 support
21 housing
25 vertical stalk
30 water discharge port
35 soap discharge port
40 sink bowl
45 water activation sensor
50 soap activation sensor
55 manual soap activation switch
60 cold water supply line
65 pressure control valve
70 hydro generator
75 electrically operated solenoid
80 liquid soap cartridge
85 liquid soap pump
90 control box enclosure
95 interconnecting cabling
100 first timing circuit
105 second timing circuit

DETAILED DESCRIPTION OF THE PREFERRED EMBODIMENT

The preferred embodiment of the present invention is depicted in FIGS. 1 through 4. However, the invention is not limited to the specifically described embodiment. A person skilled in the art will appreciate that many other embodiments of the invention are possible without deviating from the basic concept of the invention. Any such work around will also fall under the scope of this invention.

In the figures like numbers refer to like elements throughout. Additionally, the terms "a" and "an" as used herein do not denote a limitation of quantity, but rather denote the presence of at least one (1) of the referenced items.

The present invention is a hands-free, integrated soap-and-water dispensing faucet assembly, the faucet assembly 10, that is specifically designed to enhance cleanliness while reducing clutter in locations such as residential bathrooms, commercial restrooms, institutional restrooms, medical and clinical settings such as clinics and hospitals, food service areas, and other places where a clean, clutter-free and germ reducing faucet can be beneficial.

FIG. 1 presents an overall perspective view of the faucet assembly 10 installed over a sink 15. The faucet assembly 10 is attached above the sink 15 on a support 20 such as a wall or a back-plate or a mirror assembly. The support 20 mates with the faucet assembly 10 using any of a wide number of suitable fasteners such as screws, bolts, welds, snap-fittings, pegs, posts or other features. The important part is that the faucet assembly 10 is secured in place relative to the sink 15. It should be noted that while the sink 15 is depicted as resembling a residential bathroom sink, as noted above the faucet assembly 10 can be used with other styles of sinks and in other applications.

Figure 2:
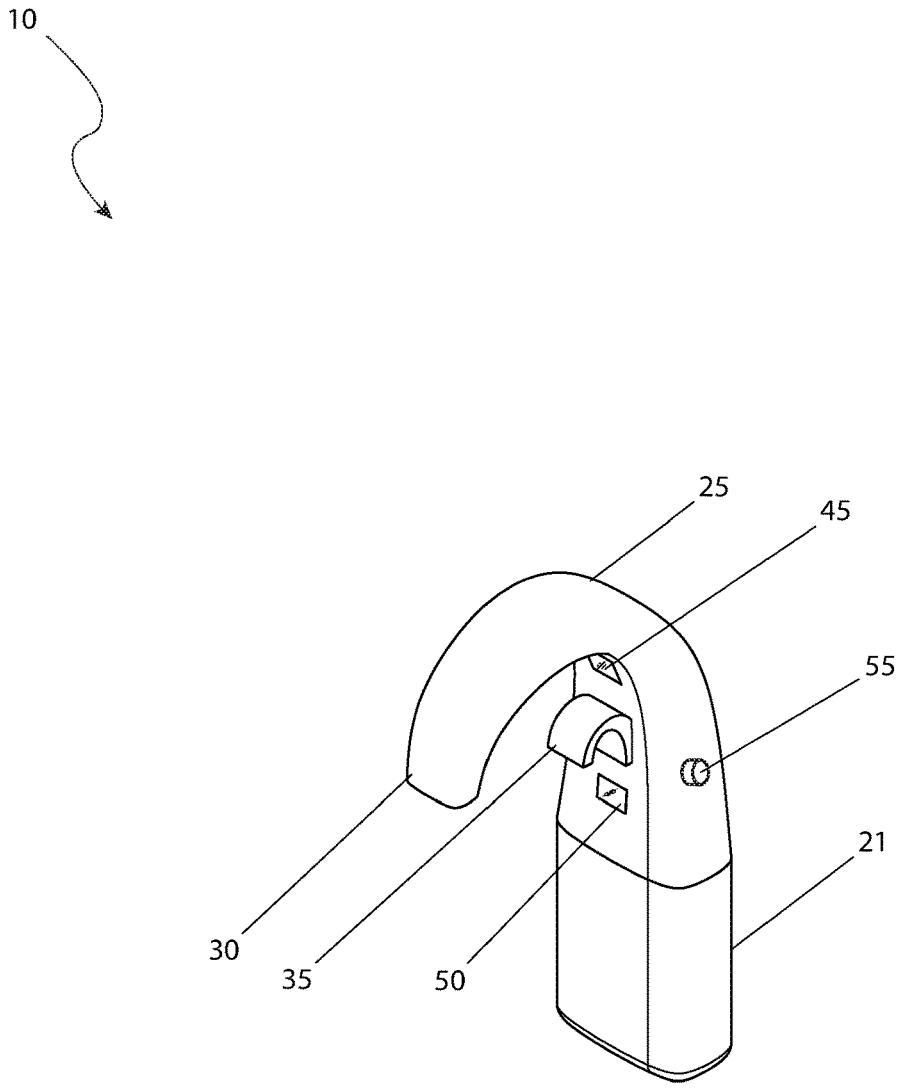
FIG. 2 presents a more detailed perspective view of the faucet assembly 10 shown in FIG. 1.
Figure 3:
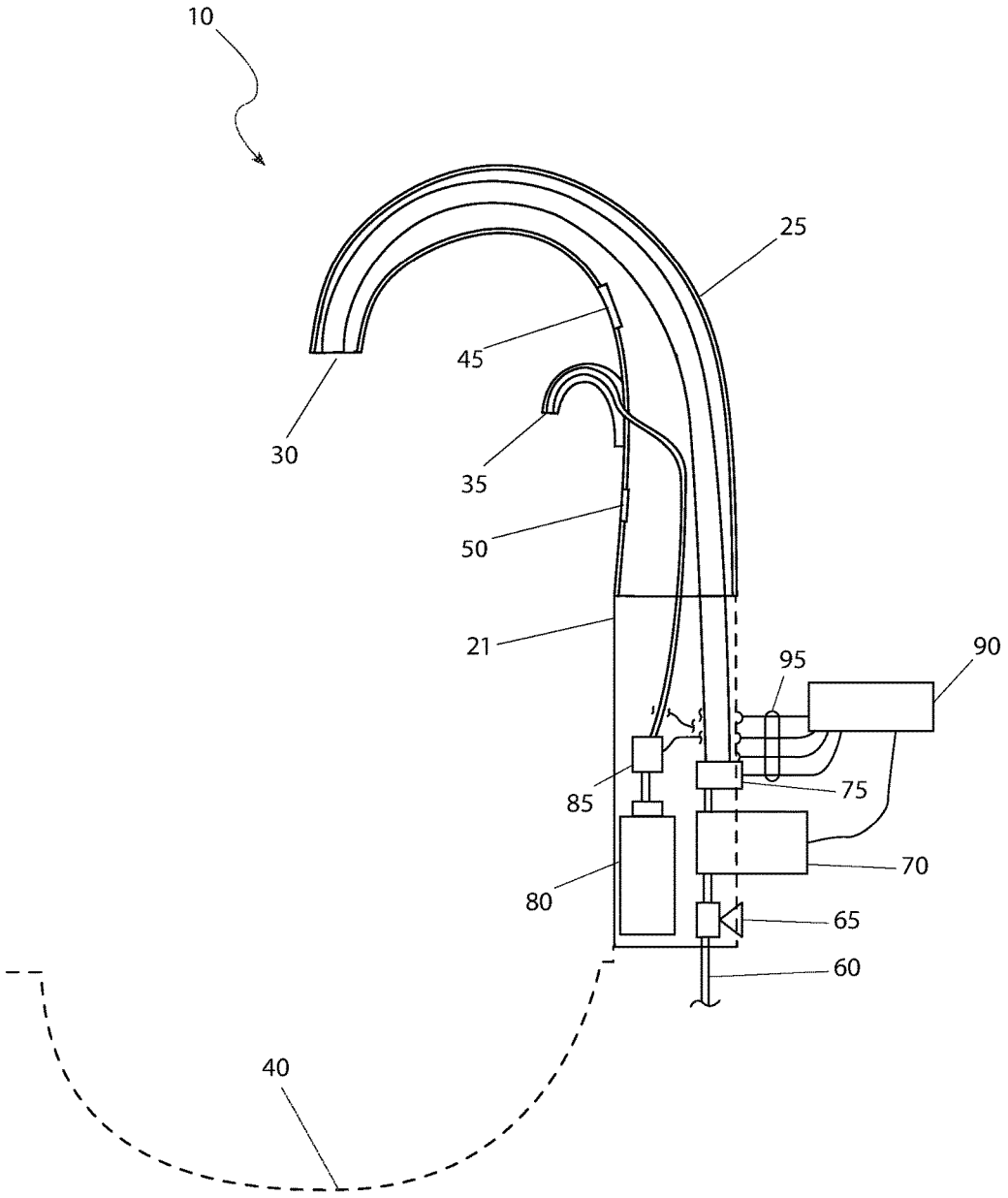
FIG. 3 is a sectional view of the faucet assembly 10 taken along line I-I of FIG. 1; and, FIG. 4 is a functional electrical block diagram of the faucet assembly 10 shown in FIGS. 1-3.

Turning now also to FIG. 2 the faucet assembly 10 includes a vertical stalk 25 which is operatively connected to a housing 21 that connects the faucet assembly 10 to an external water supply line 60 (see FIG. 3). The housing 21 can be functionally attached to the support 20 or an integral part thereof. Similarly, the vertical stalk 25 can be integral with the housing 21 and/or the support 20. The vertical stalk 25 discharges water at an end water discharge port 30 and liquid soap from a soap discharge port 35. The soap discharge port 35 is preferably located between the sink 15 and the water discharge port 30 (that is, sub-adjacent to the water discharge port 30). The housing 21 therefore functionally connects and provides fluid communication between the external water supply line 60 and the water discharge port 30.

The vertical stalk 25 accomplishes multiple purposes. Preferably it has an extended design that assists physically separating the water from the water discharge port 30 from the liquid soap from the soap discharge port 35. In addition, the extended design of the vertical stalk 25 enables a user to easily wash their hands by increasing the hand washing space between the water discharge port 30 and the bottom of the sink bowl 40 (best shown in FIG. 3). As with conventional water faucet assemblies it can be appreciated that the faucet assembly 10 should also present clean design lines that assist achieving a highly desirable uncluttered look for the sink 15. It is envisioned that the faucet assembly 10 would be made available in a wide variety of colors and styles to fit with different bathroom decors. As such the overall aesthetic design shown in FIG. 1 is not intending to be a limiting factor of the present invention.

Refer now to FIG. 2 for a more detailed perspective view of the faucet assembly 10. In addition to the water discharge port 30 and the soap discharge port 35 the vertical stalk 25 also includes both a water activation sensor 45 and a soap activation sensor 50. The soap activation sensor 50 and the water activation sensor 45 are electronic sensors such as infrared, heat (temperature), capacitive, optical or similar electronic devices, or acoustic sensors such as sonic or ultrasonic devices. They can be different types of sensor.

The water activation sensor 45 automatically initiates water discharge from the water discharge port 30 when a user's hands are placed in front of the water activation sensor 45. Likewise, the soap activation sensor 50 automatically initiates discharge of liquid soap from the soap discharge port 35 when a user's hands are placed in front of the soap activation sensor 50. In addition, the vertical stalk 25 includes a manually operated soap activation switch 55 that provides an alternative way of initiating soap discharge from the soap discharge port 35. The manual soap activation switch 55 is highly beneficial should the soap activation sensor 50 become non-operational because soap or grime are other foreign materials blocking the soap activation sensor 50. In addition, the manual soap activation switch 55 assists a user who may be more comfortable with manual activation.

It should be noted that the water activation sensor 45 and the soap activation sensor 50 are respectively located in close proximity to the water discharge port 30 and to the soap discharge port 35. It should also be noted that the water activation sensor 45 is located sufficiently away from the soap activation sensor 50 so as to enable a user to independently activate a desired sensor 45, 50 and to reduce the risk of unwanted activation of the other sensor 50, 45. To that end, the vertical stalk 25 can be designed to make it intuitively obvious to a user of ordinary skill how to use the faucet assembly 10 without undue experimentation.

For example, the neck of the vertical stalk 25 can be made rather tall and/or curved such that the water activation sensor 45 is well away from the soap activation sensor 50 (also see FIG. 3). In addition, the soap discharge port 35 can be placed below the water activation sensor 45, but above the soap activation sensor 50. Furthermore, the soap discharge port 35 can be configured to extend sufficiently out from the vertical stalk 25 so as to block the water activation sensor 45 from sensing a user's hands when those hands are receiving soap, but when they are far out enough over the sink so as to allow excess soap to drip into the sink.

In practice, the faucet assembly 10 may be used in an application such that only cold, only hot or only a special source of water is emitted from the water discharge port 30. This is beneficial because a mixing valve is not required, resulting in an overall simpler design that requires less plumbing work and eases maintenance and repair. No sacrifice in sanitary conditions results as repeated studies indicate that washing time and washing thoroughness results in reduced germs and bacteria; not the temperature of the water used. Thus, the use of a particular water source can be left to the particular application or to the installer.

When using the faucet assembly 10 the user will place their hand(s) in front of the water activation sensor 45 to trigger the flow of water. Water flow will continue as long as the user's hands are in position, up to a preset maximum time, such as twenty seconds (20 s.). This feature is important as conserving water is a priority in almost all new appliance installations. When the water flow shuts off the user moves their hands from in front of the water activation sensor 45 to below the soap discharge port 35, and thus in front of the soap activation sensor 50. Soap dispensing is then triggered. Each subsequent placement of the user's hands in front of the soap activation sensor 50 results in additional soap dispensing.

In practice, the amount of the soap that is dispensed is preset, for example, approximately one-tenth of an ounce (0.1 oz.). This feature allows the user to determine the amount of soap to be used. After briskly washing their hands the user then rinses their hands by placing it in front of the water activation sensor 45 which once again triggers the flow of water. Again, water will continue flowing as long as the user's hands are in position, up to the preset maximum time (for example twenty seconds (20 s.). The water then shuts off.

FIG. 3 presents a sectional view of the faucet assembly 10 taken along line I-I of FIG. 1. Incoming water arrives via a cold-water supply line 60 whereupon it enters a pressure control valve 65. The pressure control valve 65 provides proper water flow and pressure from the water discharge port 30 independent of the incoming water pressure. The pressure control valve 65 may also serve as an isolation valve should the faucet assembly 10 require periodic maintenance, repair, or replacement.

Water flows into a hydro generator 70 which generates a small electrical current to power the invention. The hydro generator 70 is well-known in the art and would be equal to a Toto TH559EDV504 Hydro-Power Generator or similar. Next, the water flow is controlled by an electrically operated solenoid 75. Water exiting from the electrically operated solenoid 75 is routed to the water discharge port 30 for the user. It should be noted that electrical power from the hydro generator 70 produces enough electrical power for both sensors 45, 50 and the liquid soap pump 85 and can be used to charge an auxiliary battery that provides temporary power.

Still referring to FIG. 3, liquid soap is contained within a liquid soap cartridge 80. The liquid soap cartridge 80 is attached to and accessible from under the sink 15 to enable periodic replacement. The liquid soap cartridge 80 is beneficially sealed to reduce the occurrence of tampering, bacterial infection, or the like, as well as spillage. The liquid soap cartridge 80 may use a sealed cartridge or bladder that is initially filled and then sealed in a controlled sanitary environment by its manufacturer. However, other standard solutions such as a refillable bottle from bulk storage solutions may also be used. Liquid soap is pulled from the liquid soap cartridge 80 by a liquid soap pump 85 and then discharged from the soap discharge port 35.

A control box enclosure 90 is also provided to house electronic control circuits as will be described in greater detail below. Interconnecting cabling 95 is used to electrically connect the water activation sensor 45 and the soap activation sensor 50, as well as the hydro generator 70 to the electronics within the control box enclosure 90. Also connected to the electronics within the control box enclosure 90 is an electrical power source such as a battery or a hydro generator 70, the manual soap activation switch 55 and the electrically operated solenoid 75 and liquid soap pump 85. The faucet assembly 10 could also be powered by an external outlet. It is envisioned in a preferred embodiment that the liquid soap cartridge 80, the liquid soap pump 85, the reside fully within the housing 21. Also preferably, at least a portion of the pressure control valve 65, the hydro generator 70, and the electrically operated solenoid 75 are housed within the housing 21.

Figure 4:
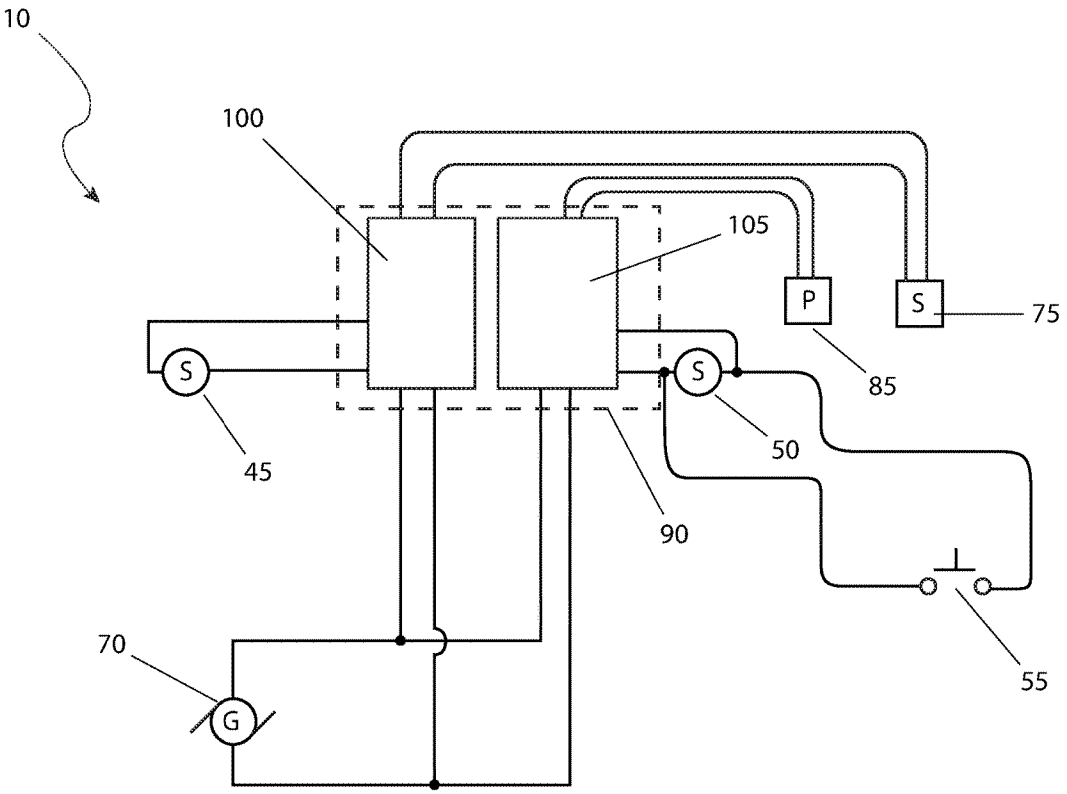

FIG. 4 presents a functional electrical block diagram of the faucet assembly 10. Electrical power from the hydro generator 70 is sent to a first timing circuit 100. The first timing circuit 100 is triggered by a signal from the water activation sensor 45. After triggering the first timing circuit 100 sends an enabling signal to the electrically operated solenoid 75 which causes water to flow from the water discharge port 30 until either the water activation sensor 45 no longer senses a user's hands or until the water flow timeout occurs (say twenty seconds). A parallel power circuit sends electrical power to a second timing circuit 105 which sends an activation pulse of approximately one second (1 s.) to the liquid soap pump 85. This activation pulse is a one-time trigger based upon an enabling pulse from the soap activation sensor 50. The soap activation sensor 50 must be disabled and re-enabled to repeat the dispensing cycle. It is envisioned that the one second (1 s.) operating cycle will result in an approximate one-tenth of an ounce (0.1 oz.) discharge of liquid soap. Both the first timing circuit 100 and the second timing circuit 105 are contained within the control box enclosure 90. Finally, the manual soap activation switch 55, if provided, is connected across the soap activation sensor 50 in a parallel manner to mimic the functionality of the soap activation sensor 50.

The present invention can be utilized by the common user in a simple and effortless manner with little or no training. It is envisioned that the faucet assembly 10 would be constructed in general accordance with FIG. 1 through FIG. 4. After procurement of the faucet assembly 10 it would be installed upon above sink 15 using well-known mechanical installation techniques. The liquid soap cartridge 80 would be installed and proper operation verified. The faucet assembly 10 is then ready for use.

To use the faucet assembly 10 a user would approach the sink 15 and would place their hand(s) in front of the water activation sensor 45 to trigger water flow. That water flow would continue as long as the user's hands are in position, up to a preset maximum time (preferably twenty seconds (20 s.) whereupon the water would shutoff; the user would then move their hand close to the soap activation sensor 50 to trigger soap discharge. Each subsequent placement of the user's hands would result in additional soap dispensing. Each dispensing is envisioned to be approximately one-tenth of an ounce (0.1 oz.). The user would then briskly rub their hands together in a conventional washing process and away from both the water activation sensor 45 and the soap activation sensor 50. The user would then return their hand(s) in front of the water activation sensor 45 to once again trigger the flow of water. Again, water flow would continue as long as the user's hands are in position, up to the preset maximum time, whereupon the water will shutoff (the user must remove their hands from in front of the water activation sensor 45 and then replace them to re-establish water flow to complete the rinsing process). This process can be completed as many times as desired.

The foregoing descriptions of specific embodiments of the present invention have been presented for purposes of illustration and description. They are not intended to be exhaustive or to limit the invention and method of use to the precise forms disclosed. Obviously, many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

The invention claimed is:

1. A faucet assembly, comprising:

said faucet assembly having an inlet port connected to a water passageway for receiving water from a water supply line and a soap passageway for receiving liquid soap, said faucet assembly further including an upwardly extending stalk having a water discharge port connected to said water passageway and a soap discharge port connected to said soap passageway;

a soap cartridge for providing liquid soap to said soap passageway;

a water activation sensor attached to said stalk, said water activation sensor in electrical communication with a water control valve in said water passageway; and, a soap activation sensor attached to said stalk, said soap activation sensor in electrical communication with a soap pump located between said soap cartridge and said soap passageway;

wherein said soap discharge port is below said water discharge port;

wherein said water activation sensor selectively causes water to flow from said water discharge port; and, wherein said soap activation sensor selectively causes liquid soap to flow from said soap discharge port;

wherein said water activation sensor causes automatic water discharge from said water discharge port;

wherein said soap activation sensor automatically causes soap discharge from said soap discharge port;

wherein said water activation sensor is above said soap discharge port and wherein said soap activation sensor is below said soap discharge port;

wherein said soap discharge port extends away from the remainder of said stalk so as to block said water activation sensor from sensing a user's hands positioned below said soap discharge port.

2. The faucet assembly of claim 1, wherein said water activation sensor is an electronic sensor.

3. The faucet assembly of claim 1, wherein said water activation sensor is an acoustic sensor.

4. The faucet assembly of claim 1, further comprising a manually operated soap activation switch for initiating soap discharge from said soap discharge port.

5. The faucet assembly of claim 1, wherein said water discharge port only discharges cold water.

6. The faucet assembly of claim 1, further comprising a hydro-generator in said water passageway which is capable of generating electrical power for said water activation sensor, said soap pump, and said soap activation sensor.

7. The faucet assembly of claim 6, further comprising a pressure control valve in said water passage.

8. The faucet assembly of claim 1, wherein said soap cartridge is sealed.

9. A faucet assembly, comprising:

a base plate;

a sink;

said faucet assembly connected to said base plate and above said sink, said faucet assembly having an inlet port connected to a water passageway for receiving water from a water supply and a soap passageway for receiving liquid soap, said faucet assembly including an upwardly extending stalk having a water discharge port connected to said water passageway and a soap discharge port connected to said soap passageway;

a soap reservoir cartridge configured to be attached to said sink;

an automatic water dispensing device having a water activation sensor attached to said stalk;

an automatic soap dispensing device having an automatic soap activation sensor attached to said stalk; and, a manually operated soap activation switch attached to said stalk, said manually operated soap activation switch being in electrical communication with said automatic soap dispensing device;

wherein said automatic water dispensing device is for automatically discharging water from said water discharge port when a user's hands are sensed by said water activation sensor;

wherein said automatic soap dispensing device is for automatically discharging soap from said soap discharge port when a user's hands are sensed by said automatic soap activation sensor; and, wherein said water activation sensor is above said soap discharge port while said automatic soap activation sensor is below said soap discharge port;

wherein said soap discharge port extends away from said stalk sufficiently to block said water activation from sensing a user's hands positioned below said soap discharge port.

10. The faucet assembly of claim 9, wherein said automatic water dispensing device automatically discharges water for no more than a preset period of time.

11. The faucet assembly of claim 10, wherein said automatic water dispensing device automatically stops discharging water when a user's hands move away from said water activation sensor.

12. The faucet assembly of claim 9, wherein said automatic soap dispensing device automatically discharges a predetermined volume of soap when said automatic soap activation sensor senses a user's hand.

13. The faucet assembly of claim 12, wherein said automatic soap dispensing device automatically discharges a predetermined volume of soap when said manually operated soap activation switch is pressed.

14. The faucet assembly of claim 9, wherein said automatic water dispensing device includes a first timing circuit triggered by said water activation sensor.

15. The faucet assembly of claim 9, wherein said soap reservoir cartridge is sealed.

* * * * *